US010455329B2

(12) United States Patent
Jacques

(10) Patent No.: US 10,455,329 B2
(45) Date of Patent: Oct. 22, 2019

(54) PLANAR DYNAMIC TRANSDUCER

(71) Applicant: Sennheiser electronic GmbH & Co. KG, Wedemark (DE)

(72) Inventor: Roland Jacques, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 130 days.

(21) Appl. No.: 15/723,265

(22) Filed: Oct. 3, 2017

(65) Prior Publication Data

US 2018/0098156 A1 Apr. 5, 2018

(30) Foreign Application Priority Data

Oct. 4, 2016 (DE) ..... 10 2016 118 706

(51) Int. Cl.
*H04R 9/04* (2006.01)
*H04R 9/02* (2006.01)

(52) U.S. Cl.
CPC ..... *H04R 9/047* (2013.01); *H04R 9/025* (2013.01)

(58) Field of Classification Search
CPC ..... H04R 9/047; H04R 9/025; H04R 9/02; H04R 9/04; H04R 9/22; H04R 9/06
See application file for complete search history.

(56) References Cited

U.S. PATENT DOCUMENTS 3,013,905 A * 12/1961 Gamzon et al. ..... B06B 1/04 381/427
3,674,946 A 7/1972 Winey
3,898,598 A * 8/1975 Asahi ..... H04R 9/047 335/231
4,210,786 A * 7/1980 Winey ..... H04R 9/047 381/408
4,384,173 A * 5/1983 Briefer ..... H04R 9/047 381/354
4,468,530 A * 8/1984 Torgeson ..... H04R 9/047 381/402
4,471,173 A * 9/1984 Winey ..... H04R 9/047 181/170
4,837,838 A * 6/1989 Thigpen ..... H04R 9/047 181/172

(Continued)

FOREIGN PATENT DOCUMENTS

AU 2014 201 937 10/2014

*Primary Examiner* — Helen C Kwok
(74) *Attorney, Agent, or Firm* — Haug Partners LLP

(57) ABSTRACT

Known planar dynamic sound transducers include a flat, multipole magnet arrangement having parallel magnet bars which are arranged with intermediate spaces and which have a uniform magnetization in the direction of one of the short dimensions. The magnet bars are parallel to the conductors of a coil that are applied to a diaphragm and on their side towards the diaphragm include precisely one kind of magnetic poles. The current planar dynamic sound transducer includes a magnet plate with elongate air gaps extending transversely relative to the conductor. The magnet plate is one-sided multipole magnetized so that on the side towards the diaphragm and the conductor it includes at least one North pole and one South pole respectively at both sides along each air gap. The width of the air gaps in the magnet plate can be freely selected because it does not depend on the width of the conductor tracks.

14 Claims, 4 Drawing Sheets

(56) References Cited

U.S. PATENT DOCUMENTS

| | | | | |
|---|---|---|---|---|
| 5,003,609 | A * | 3/1991 | Muraoka | H04R 9/047 381/117 |
| 5,901,235 | A * | 5/1999 | Thigpen | H04R 13/00 381/399 |
| 6,934,402 | B2 * | 8/2005 | Croft, III | H04R 7/22 381/191 |
| 7,929,725 | B2 * | 4/2011 | Sugiura | H04M 1/03 381/399 |
| 9,736,576 | B2 * | 8/2017 | Shinotsuka | H04R 1/34 |
| 2003/0068054 | A1 * | 4/2003 | Sotme | H04R 7/04 381/152 |
| 2010/0214047 | A1 * | 8/2010 | Sakai | H04R 9/047 335/306 |
| 2016/0173989 | A1 * | 6/2016 | Jacques | H04R 7/04 381/419 |
| 2016/0212544 | A1 * | 7/2016 | Jacques | H04R 9/025 |
| 2016/0212546 | A1 | 7/2016 | Salvatti | |

* cited by examiner

PLANAR DYNAMIC TRANSDUCER

The present application claims priority from German Patent Application No. 10 2016 118 706.2 filed on Oct. 4, 2016, the disclosure of which is incorporated herein by reference in its entirety.

FIELD OF THE INVENTION

It is noted that citation or identification of any document in this application is not an admission that such document is available as prior art to the present invention.

The invention concerns a planar dynamic transducer, in particular a planar dynamic sound transducer.

A number of different operating principles are known for sound transducers. The moving coil principle is frequently used, in which a force is exerted on a cylindrical coil which is fixed to a diaphragm and through which current flows, in the magnetic field of a round permanent magnet. In contrast thereto, sound transducers operating on the planar dynamic principle have flat permanent magnets and a flat coil which generally comprises conductor tracks fixed directly on the diaphragm.

Sound transducers of the planar dynamic type (also referred to as planar magnetic, orthodynamic, isodynamic or magnetostatic) belong to the family of dynamic and electromagnetic sound transducers. The principle is shown in FIG. 1. It is based on a flat multi-pole magnet arrangement 100 which is generally made up of parallel magnet bars 100*a*, 100*b* which are arranged with intermediate spaces 101 (referred to hereinafter as horizontal air gaps) and which involve magnetization in the direction of one of the short dimensions (that is to say perpendicularly or horizontally relative to the plane of the magnet bar arrangement). Optionally disposed in opposite mirrored relationship therewith is a second identical arrangement 106 which in some cases is also additionally laterally displaced. As in that case identical poles are in opposite relationship the arrangements 100, 106 repel each other and have to be assembled with a strong stable structure. Generally strip-shaped magnetic fields or magnetic zones 102 are produced, wherein the direction of magnetization respectively alternates from one magnet bar 100*a* to the next 100*b*. The field lines or the vector of the magnetic flux density extends in the direction of the short dimension of the magnetic zones or the magnet bars. A variant which is more rarely used employs concentric magnet rings or apertured magnet disks which are magnetized in the form of concentric zones. The operating principle however is the same.

Disposed beneath the magnet arrangement 100 or between the two magnet arrangements 100, 106 is a flat diaphragm 110 which often comprises thin plastic film or polyester film. Applied thereto is an electrical conductor 120 in the form of a thin wire or a for example vapor-deposited conductor track which functions as a coil and the position and direction of which correspond to the magnetic zones. Normally therefore the conductor follows a meander shape. In many cases it is then taken back a number of times at the edge or outside the moveable diaphragm portion in order once again to follow the same meander path with a small displacement. That results in the production of conductor track bundles which are directed in the same direction and which represent additional turns of the coil. These multiply the conductor length and, with the total electrical resistance being kept the same, also multiply the drive power and the sound pressure. In the case of the concentric variant the conductor is correspondingly arranged in a spiral configuration and generally has a plurality of turns per magnetic zone 102, the center point of the diaphragm generally being fixed for contacting purposes.

In all those cases the magnetic field lines 103 in the magnetic zones 102 extend through the plane of the diaphragm and perpendicularly to the flow of current in the conductor 120. As a result, in all portions of the conductor, that extend through the magnetic zones 102, there is a force which is in the same direction and which is normal in relation to the diaphragm surface and which deflects the diaphragm and thus generates sound pressure.

With that principle basically compromises have to be accepted in regard to the conductor mass, the magnet mass and the sound pressure which can be produced. A reduction in the conductor mass by virtue of a shorter conductor length or a smaller conductor cross-section admittedly provides for a lower degree of mass damping in respect of higher frequencies, but, because of the lesser current flow, it also reduces the drive power and thus the sound pressure produced. A smaller mass in respect of the magnet arrangements reduces not only the thickness and weight of the sound transducer but also the acoustic damping, reflection phenomena and other acoustic influences, but because of the correspondingly lower magnetic flux density it also reduces the drive power and the sound pressure.

Conventional configurations as in FIG. 1 mostly used bar-shaped or ring-shaped magnets 100*a*, 100*b* with horizontal air gaps 101 therebetween for the flow of sound, which produce correspondingly strip-shaped or ring-shaped local magnetic fields or magnetic zones 102 both on the useful side and also on the outside. To maximize the level of efficiency it is advantageous for the magnetic poles disposed on the outside to be connected by a suitable ferromagnetic structure in order to reduce the reluctance of the magnetic circuit and to increase the flow density on the useful side (that is to say inwardly). That requires a connection between adjacent magnet bars and impedes the flow of sound between the magnets. Therefore that connection has to be in the form of a thin grid, whereby it is not possible to achieve complete return, or it is necessary to entirely dispense with that connection.

The electrical conductor 120 is disposed in the region of the magnetic zones 102 on the diaphragm 110 which is fixed on a carrier frame 130. Accordingly the drive power also acts only in those regions of the diaphragm. In many configurations the conductor is very wide or a plurality of conductors which are positioned in parallel are used. However the magnetic field falls off greatly towards the edge of those wide conductors as a change in polarity with a zero crossing occurs at the transition between the magnetic zones. As shown in the cross-section in FIG. 2 therefore the major part of the drive power 200 occurs in the center of the horizontal air gaps 101 between mutually juxtaposed magnets 100*a*, 100*b*. In contrast the drive power is missing in the vertical air gaps directly under the magnets. There the diaphragm is deflected only by the elastic connection of the diaphragm film to the driven regions. In that case they are also influenced by the adjacent mass of air between the diaphragm film and the magnets, insofar as a spring-mass system is produced which can lead to vibration modes at given frequencies.

At the same time the magnets 100*a*, 100*b* inevitably represent a locally changing acoustic load in regard to the diaphragm. In the horizontal air gaps 101 the local volume of air which is relevant at medium and high frequencies, or the column of air, is greater than in the region under the magnets which there delimit the volume or the column of air.

Upon deflection of the diaphragm that smaller volume is more greatly compressed and decompressed respectively and therefore generates an increased counteracting force or damping action 210 which locally retards the movement of the diaphragm.

Those two effects in themselves can already result in measurable and audible impairments which however can be partially mastered with suitable acoustic and/or mechanical measures. It will be noted however that both effects spatially coincide in the configuration which is most frequently used: the driven diaphragm regions, due to the principle involved, are in the horizontal air gaps 101 where there is even less acoustic damping while the non-driven regions are subject to a higher level of damping. This can therefore entail unwanted strip-shaped or ring-shaped vibration modes of the diaphragm, and therefore deviations from the desired even and in-phase movement of the diaphragm. These can reduce or in the extreme case extinguish the desired emission of sound. Those vibration modes can also locally result in very severe deflections, whereby the diaphragm material can be stretched beyond the linear range so that a non-linear characteristic and thus harmonic distortions of the sound signal occur. Such behaviour can also arise due to other influences. If however the magnet and conductor track geometry extend parallel, as is usual in many configurations, those two influences are added and increase the problem. In that case stronger counteracting measures are required, which can have unwanted side effects. For example an acoustic damping element reduces the vibration mode, but also decreases the sound pressure which can be achieved in a wider frequency range.

U.S. Pat. No. 3,674,946 discloses a planar dynamic sound transducer having a flat perforated multipole magnet. That arrangement avoids the above-described accumulation of influences which occur in parallel as basically the openings which permit the flow of sound and thus the acoustic loads or volumes can be distributed spatially as desired and independently of the drive system, by the perforation holes being appropriately positioned. The one-sided multipole magnetization described in U.S. Pat. No. 3,674,946, for example in FIG. 29, is also known as a Halbach magnet array and is basically advantageous as it produces almost no magnetic stray fields. The magnetic flux however is interrupted by the perforations required for the flow of sound and corresponding stray fields and losses occur. These are correspondingly greater, the larger or more numerous that the perforations are. Smaller or fewer perforations however more greatly impede the flow of sound.

AU 2014 201 937 A1 shows a modular-structure planar dynamic transducer with a plurality of permanent magnet cubes which are arranged in the form of a linear Halbach array and which are held together by a holding means. Insertion of the magnet elements into the holding means is difficult and accordingly costly and also susceptible to error. In addition the resulting magnetic field includes abrupt changes and bent field lines. The same applies to US No 2016/0212546 A1 which also discloses a planar dynamic transducer with a Halbach array consisting of a plurality of individual elements.

SUMMARY OF THE INVENTION

In consideration of the above-described limitations and disadvantages in the state of the art an object of the present invention is to provide an improved planar dynamic transducer. In particular the invention aims to resolve the above-mentioned problems by means of an improved magnet arrangement.

According to the invention a planar dynamic transducer includes at least one permanently magnetized magnet plate and at least one diaphragm with a substantially flat coil fixed thereto or thereon. The magnet plate is magnetized in one-sided multipole fashion, a plurality of magnetic poles being disposed on a side towards the diaphragm. The magnet plate includes at least two elongate air gaps which extend substantially parallel and at least one limb respectively remaining between two air gaps (magnet limb). A plurality of magnetic poles, namely at least one North pole and one South pole respectively, are respectively disposed on the magnetized side of the magnet plate at both sides along the air gap or the air gaps. The coil extends transversely relative to the air gaps and the at least one magnet limb, for example in a meander configuration, wherein the conductor tracks of the coil are between the North and South poles of the magnet limb. Then, when there is a flow of current through the coil, forces in the same direction are exerted on the conductor tracks of the coil directly under the magnet limb, and they deflect the coil and thus the diaphragm. For a higher level of efficiency the coil can in known manner comprise a plurality of conductor tracks which are directed in the same direction and which form conductor track bundles. In addition, for a higher level of efficiency, it is possible to increase the number of air gaps and the magnet limbs. In that case a plurality of similar or identical limbs are arranged in mutually juxtaposed and substantially mutually parallel relationship. In that case, between the limbs there remains a gap which here is also referred to as a horizontal air gap. When there are more than two horizontal air gaps, they can be of equal width. The horizontal air gaps however can also be of differing width, for example one air gap can be wider than the others. That has the advantage that the transmissibility for higher frequencies is improved by the wider air gap.

An advantage of the invention is that the forces acting on the diaphragm are at the greatest precisely where the acoustic load is at its greatest, namely directly under the limb of the magnet plate or—in the case of magnet arrangements on both sides of the diaphragm—between the mutually opposite magnet limbs. A further advantage of the invention is that, when using an arrangement of a plurality of magnet limbs, the number thereof and the width of the horizontal air gaps, that is to say the spacings between the magnet limbs, is independent of the number or width of the conductor tracks or the conductor track bundles directed in the same direction, because they extend transversely relative to the magnet limbs. In that way the drive power of the diaphragm is uncoupled from the acoustic load because the two can be adjusted independently of each other. In particular the outlet of sound can be simplified by the increased width of the horizontal air gap. Yet a further advantage of the invention is that the magnet plate can be produced in one piece so that there is no need for elementary magnets to be assembled. In addition the arrangement according to the invention of multipole magnet limbs which are perpendicular to the conductors is optimum in order to utilize as far as possible the concentration of the magnetic flux in the useful range, that occurs in the case of single-sided multipole magnetization.

BRIEF DESCRIPTION OF THE DRAWINGS

Further details and embodiments by way of example of the invention are shown in the drawings. The components shown in the drawings are not always shown true to scale in order better to illustrate the details of the invention. In the drawings.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 3:
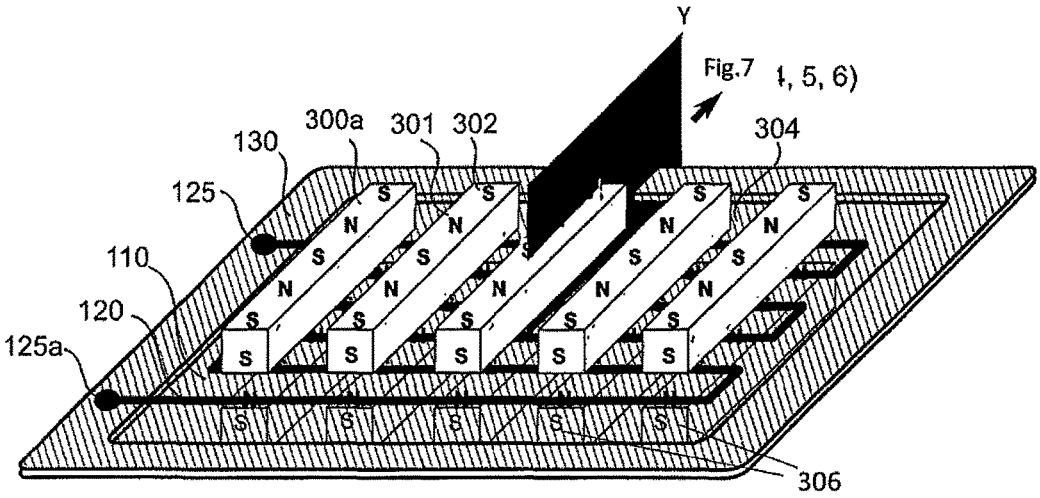
FIG. 3 shows an overview of the arrangement of magnet limbs and conductor tracks in the planar dynamic transducer according to the invention.

FIG. 3 shows an overview of the arrangement of air gaps 304 and limbs 300*a* disposed therebetween of a magnet plate 300 and conductor tracks of a planar dynamic transducer according to an embodiment of the invention. This arrangement uses a plurality of air gaps and a plurality of limb-like one-sided multipole magnets arranged transversely relative to the electrical conductors 120 on the diaphragm 110 or relative to the effective regions thereof. The outer regions of the magnet plate which surround and connect the limbs at their head ends are not shown here. The effective regions of the conductors are those which extend transversely relative to the magnets because, when there is a flow of current in the conductor, a normal deflection force acts on those regions. In an embodiment the conductors are meander-shaped.

Figure 1:
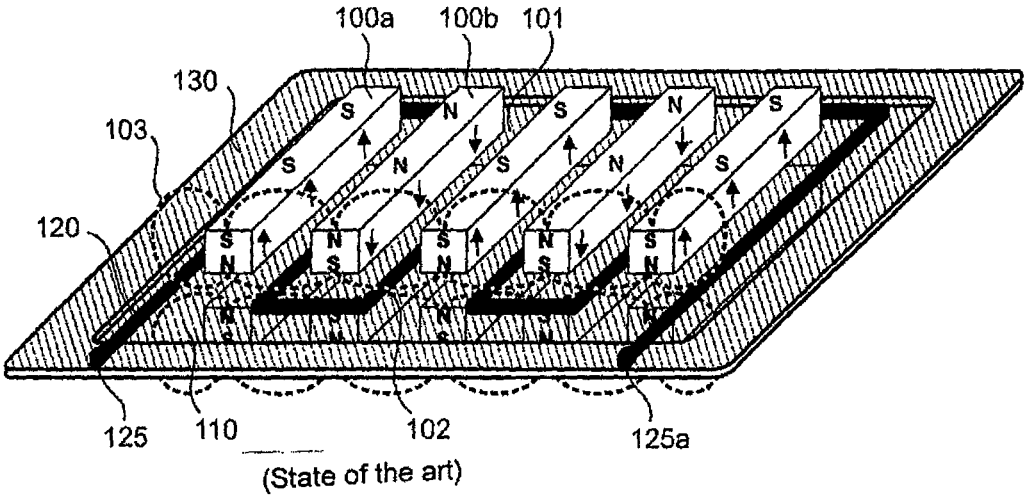
FIG. 1 shows the structure in principle of a known planar dynamic transducer.
Figure 2:
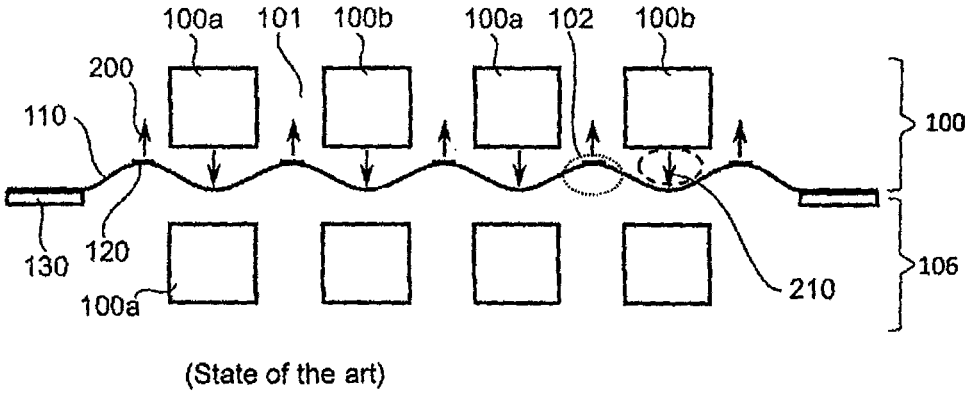
FIG. 2 shows forces acting on the diaphragm in the known planar dynamic transducer.

In contrast to the conventional magnet bars or rings having respectively precisely one North and one South pole which each extend over an entire outside surface of the magnet, as shown in FIG. 1, according to the invention however the magnet bar is magnetized in multipole relationship and only at one side. The useful side, that is to say the outside surface of the magnet, that faces towards the diaphragm and the conductor, therefore has at least one North pole and at least one South pole. The configuration of the magnetization is such that the alternating multiple poles 301, 302 and the corresponding magnetic fields 303 (see FIG. 7) are on the useful side. For reasons of better visibility, FIG. 3 shows the poles 301, 302 at the top side of the magnet limbs 300 although they are only at the underside which here is the useful side. The number of poles per side can be even or odd. The configuration of the magnetic field lines in the section plane Y extending through the length of the magnet bar is shown by way of example in FIG. 7 and described hereinafter.

Figure 4A:
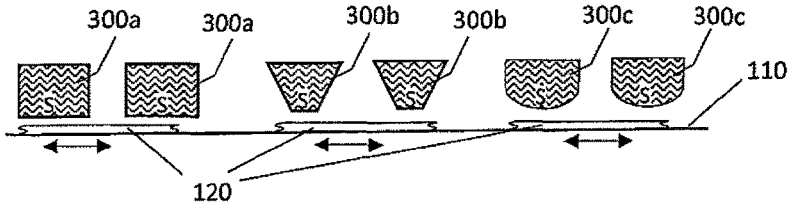
FIG. 4*a* shows magnet limbs involving different cross-sections.

FIG. 4*a* shows various embodiments involving different cross-sections of the limbs of the magnet plates or different cross-sections of the air gaps. As shown in FIG. 4*a* the cross-section of the limbs of the magnet plates or the cross-section of the air gaps can be selected as may be desired, for example square, rectangular, half-round, round, triangular or trapezoidal. The side of the magnet limbs that is towards the diaphragm may also be wider or narrower than the remote side. The magnet limbs 30*a-c* are so arranged that identical poles are always at the same height in relation to the conductor tracks, for example South poles, as shown in FIG. 4*a*. The direction of the conductors 120 and the possible current flow directions are indicated in FIG. 4*a*; it is to be noted however that the conductors do not extend directly under the poles of the magnets (see FIG. 7). In addition, as shown in FIG. 3, a mirror-image magnet arrangement 306 can be disposed beneath the diaphragm, in which case the respectively oppositely disposed magnet limbs can be of the same or different sizes and/or can be of differently shaped cross-sections.

Figure 4B:
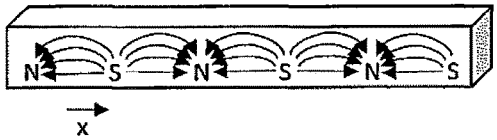
FIG. 4*b* shows one-sided multipole magnetization of the magnet plate or magnet limbs.

The one-sided multipole magnetization as shown in FIG. 4*b* is used for magnetization of the multipole magnet plate. In that respect it is possible for the magnet poles to be arranged on the useful side (in this case underneath) and connected together there without field lines issuing on the outside (in this case upwardly). The production of such magnet bars is known: for example magnetized segments can be arranged in a row with each other with an angle increment in respect of the magnetization direction of for example 90° in each case. Smaller angles with correspondingly smaller magnet segments are also possible. It will be appreciated that it is not possible to achieve a continuously rotating magnetization direction with that method. The magnet plate according to the invention however can be produced in one piece similarly to the perforated magnet plate disclosed in U.S. Pat. No. 3,674,946 without using individual magnetic segments. The field lines generated in the magnet plate according to the invention are however continuously arcuate without abrupt changes in the magnetic field or stray fields occurring; the magnetization direction produced therefore rotates continuously over the path x transversely relative to the conductor tracks, as shown in FIG. 4*b*. In the case of anisotropic materials, during magnet production, a corresponding preferential direction is produced by orientation of the crystal axes of the particles. No lossy stray field occurs on the outside of the magnet arrangement by virtue of the one-sided nature of the poles in the magnet plate. The magnetic flux density on the useful side can be maximized by the entire magnet being fully saturated (polarized).

Figure 5A:
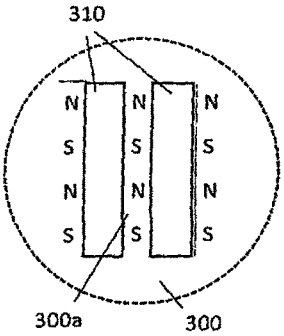
FIGS. 5A-5C shows by way of example various diaphragm forms and arrangements of limbs and air gaps.
Figure 5B:
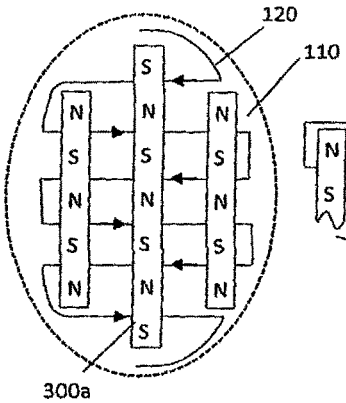
Figure 5C:
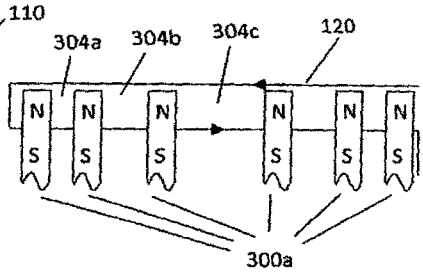

FIG. 5 shows plan views by way of example of various magnet arrangements according to the invention. In FIG. 5*a* the magnet plate 300 includes two air gaps 310 and the magnet arrangement has a magnet limb 300*a* or three identically magnetized regions at both sides along the air gap 310, each having two North and South poles per region. The diaphragm 100 is approximately round in this example. To illustrate the functional principle involved, FIG. 5*b* shows only those magnetized regions of the magnet plate but not the surrounding outer regions of the magnet plate. The arrangement again includes two air gaps and three magnetized regions, of which however one is longer than the other two. The diaphragm 110 is oval in this example. FIG. 5*b* also shows the conductor 120. Basically the air gaps and thus the magnetized regions of the magnet plate can be of different lengths. It will be noted however that identical poles are always at the same height relative to the conductor, that is to say the conductor 120 is disposed in the region of maximum field strength between the same poles. For example in FIG. 5*b* the current in the conductor always flows in the "East" direction (towards the right if a North pole is up and a South pole is down, or towards the left in the reverse case). As a result forces in the same direction everywhere act on the conductor and thus on the diaphragm. The current direction and thus the direction of the force change in relation to time, corresponding to the applied electrical signal. FIG. 5*c* shows an arrangement with a plurality of limbs 300*a* (again without surrounding regions) of the magnet plate, wherein at least some of the horizontal air gaps 304*a-c* therebetween are of differing width. A wider horizontal air gap 304*c* has a lower level of sound resistance than a narrow horizontal air gap 304*a* so that the sound outlet is improved. It is to be noted that FIG. 5 only shows the principle; to increase the effectiveness of the sound transducer the number of air gaps or magnet limbs and/or the turns of the conductor can be greater than is shown here.

Figure 6:
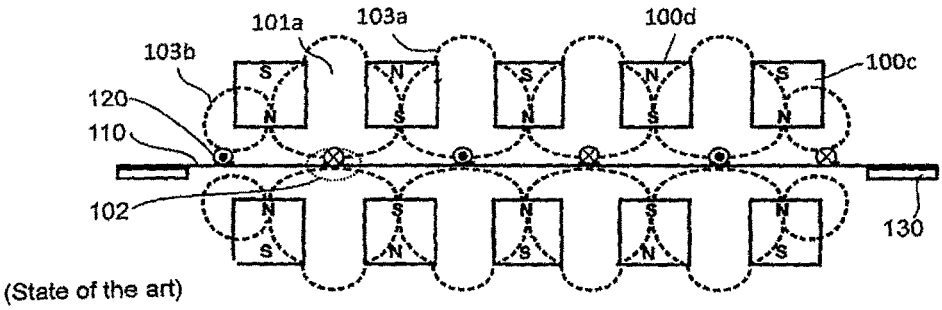
FIG. 6 shows a diagrammatic view of the magnetic fields in a known magnet arrangement which is magnetized on two sides.

FIG. 6 shows a cross-section through a known structure similarly to FIG. 1, wherein, instead of the magnet plate which is provided with air gaps according to the invention and magnetized at one side, a perforated flat magnet 100*c*, 100*d* with continuous magnetization is used. The perforation holes 101*a* in this case replace the horizontal air gaps according to the invention. FIG. 6 also shows the associated magnetic field lines 103*a*, 103*b* which show the magnetic flux. This is inevitably interrupted by the perforation holes 101*a* (as can be seen by the bend in the field lines 103*a*), whereby stray fields and losses occur. These are substantially reduced or completely eliminated in the arrangement according to the invention.

Figure 7:
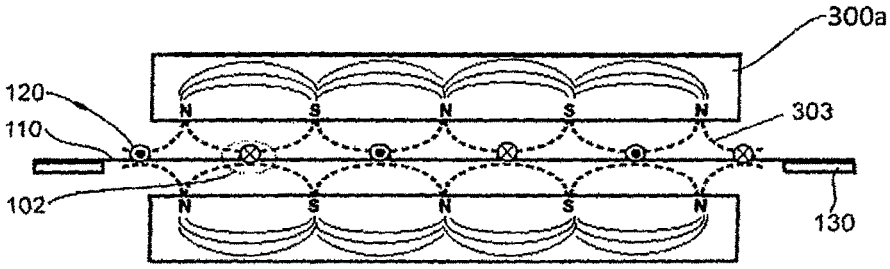
FIG. 7 shows a diagrammatic view of the magnetic fields along a one-sided multipole magnetized magnet limb in a two-sided arrangement.

The use according to the invention of one-sided multipole magnet bars has advantages here, for no bent field lines occur, the magnetic fields are more homogeneous and magnetic stray losses are further reduced. FIG. 7 shows a diagrammatic view of the magnetic fields along a portion (for example of the limb 300*a*) of the magnet plate, that is one-sided multipole magnetized, and the position of conductor tracks extending transversely relative thereto on the diaphragm, corresponding to a section in the plane Y of the perspective view in FIG. 3. The conductors 120 are disposed approximately centrally between the adjacent North and South poles of the same magnet limb 300*a* because it is there that the magnetic zone 102 is at its greatest. In addition effective regions of the conductor can be disposed in front of the air gap (that is to say in front of the short side of the air gap) of the magnet plate because the magnet plate 300 also there produces a magnetic field 303 which when a current is flowing exerts a force on the conductor.

In contrast to known arrangements the arcuate field lines which indicate the connection of the magnet poles extend uniformly and are nowhere interrupted. In addition, an operative magnetic flux is also present in the horizontal air gap 101 between adjacent limbs, depending on the respective spacing involved.

One effect of the multipole magnetization is concentration of the magnetic flux directly under the magnet bar, both in front of and behind same. The arrangement according to the invention of the magnet bars utilizes that effect as far as possible by virtue of the useful region being arranged there.

Figure 8A:
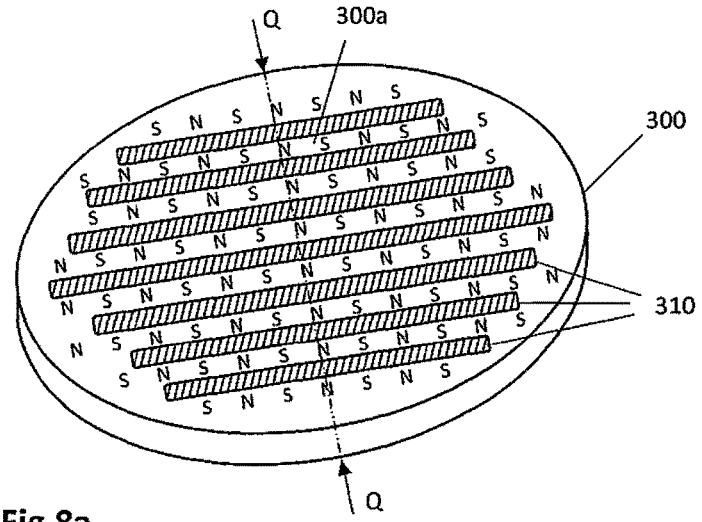
FIGS. 8A-8C shows a diagrammatic view of a one-sided multipole magnetized magnet plate with elongate air gaps.
Figure 8B:
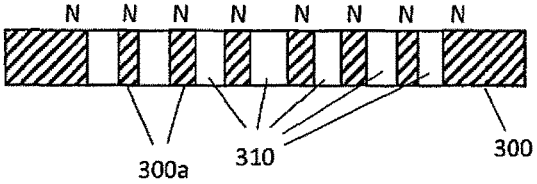
Figure 8C:
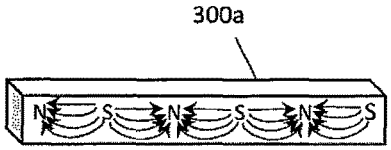

FIG. 8 shows a one-sided multipole magnetized magnet plate having elongate air gaps. In this respect FIG. 8*a* shows a diagrammatic view of the magnetized side, FIG. 8*b* shows a cross-section along line Q-Q and FIG. 8*c* shows the magnetization in the longitudinal direction of a portion of the magnet plate, which is laterally beside an air gap or between two air gaps. The magnet plate 300 can be produced in one piece, for example from metal. The air gaps 310 are elongate and substantially parallel to each other and can be for example stamped, milled or cut out in a casting operation. Each air gap has a narrow side and a markedly longer long side which extends for example over at least a quarter of the magnet plate. Limbs 300*a* of the magnet plate remain between the air gaps 310. Then (or previously) the magnet plate is one-sided multipole magnetized, in which case a plurality of magnet poles are respectively arranged at one side on the magnet plate 300 or on the limbs 300*a*, at both sides along the air gaps. In that case identical magnet poles are always disposed on notional lines extending at a right angle to the air gaps. Therefore, in a sectional view as shown in FIG. 8*b* along the line Q-Q which extends at a right angle to the air gaps 310, only identical magnetic poles are to be seen (in this example magnetic North poles). Because of the one-sided magnetization they are only on one side of the magnet plate 300 while there are no magnetic poles on the other side. While the limbs 300*a* are of a rectangular cross-section in the illustrated embodiment other cross-sections are also possible, for example corresponding to the cross-sectional shapes 300*b*, 300*c* shown at the top in FIG. 4, or the like. In an embodiment each limb 300*a* includes a plurality of magnetic North and South poles 301, 302. A diagrammatic sectional view as shown in FIG. 8*c* along a limb 300*a* shows that various magnetic poles alternate along the limb and that there are no magnetic poles on the non-magnetized side. It is to be noted that the dimensional relationships shown in FIG. 8 are not necessarily true to scale. For example the magnet plate 300 can also be in the form of a thin magnetic sheet.

In an embodiment the invention concerns a planar dynamic transducer having a magnet arrangement with at least one permanently magnetized magnet plate and a diaphragm with a flat coil fixed thereto, wherein the magnet plate is one-sided multipole magnetized so that there are a plurality of magnetic poles on a side towards the diaphragm. In the case of the magnetic poles North and South poles alternate and the total number of poles per side can be even or odd (at least two). The magnet plate 300 has at least two elongate air gaps 310 extending transversely relative to conductor tracks. For example, in the case of meander-shaped conductor tracks, the air gaps can extend in substantially mutually parallel relationship, as shown in FIG. 5*b*. Between two respective air gaps, the magnet plate forms a limb which is also one-sided magnetized. Therefore, a plurality of magnetic poles are respectively disposed on the magnetized side of the magnet plate at both sides along the air gaps, each having at least one respective North and South pole. In addition one or more conductor tracks in the same direction of the coil are disposed between the North and South poles of the magnet bar and extend transversely relative to the at least two air gaps. In operation, that is to say when current flows through the conductor track, a force acts thereon, which deflects the diaphragm in the direction of the normal. There are no magnetic poles on the side of the magnet plate that is towards the diaphragm.

In an embodiment the magnet arrangement includes at least three air gaps, wherein a plurality of magnetic poles having at least one North and one South pole respectively are disposed on the magnetized side of the magnet plate at both sides along each air gap. In that arrangement the air gaps can be of differing widths or of the same width.

In an embodiment a magnet arrangement of an identical mirror-symmetrical configuration is disposed on the other side of the diaphragm, as shown in FIG. 7. In another embodiment another magnet arrangement, for example a conventional arrangement with the known two-pole magnet bars, is disposed on the other side of the diaphragm. In an embodiment at least one limb of the magnet plate is of a non-rectangular cross-section.

In an embodiment the invention concerns a microphone having a planar dynamic transducer as described above. In another embodiment the invention concerns a headphone, an earphone or a loudspeaker having at least one of the above-described planar dynamic transducers.

An advantage of the invention is that the magnet plates with elongate air gaps produce a homogeneous magnetic field, in contrast to disk-shaped perforated magnets. That provides for more uniform deflection of the diaphragm and thus a better sound. A further advantage of the invention is that, in production or magnetization of the magnet plate, the spacing between magnetic poles on the useful side can be adjusted. It can therefore be adapted to the width of the conductor tracks used and is independent of the width or the horizontal air gaps. In that way at least one air gap can be wider than usual, which provides for improved sound emission, in particular at higher frequencies.

As a further advantage the invention permits decoupling of the drive power and the acoustic load as they extend spatially not in parallel but in mutually perpendicular relationship. The two influences cancel each other out and even at critical frequencies endangered by vibration modes, lead to effective deflection which is more uniform over the entire diaphragm area. Thus the invention improves even and in-phase movement of the diaphragm and reduces unwanted vibration modes and distortion. That results in improved sound quality in operation of the sound transducer as a sound generating device and improved signal quality in operation of the sound transducer as a sound pickup.

It is also advantageous that the maximum of the magnetic field is not as conventionally in the region of the horizontal air gap, equidistant in relation to the four closest magnet bars. Instead the maximum of the magnetic field and thus the greatest deflection force is directly beneath the magnet plate or, in the case of a mirror-symmetrical arrangement, between two mutually opposite magnet plates where acoustic damping is also at its maximum. As a result such damping is reduced most effectively.

The invention can be used generally for planar dynamic transducers, for example in sound transducers, vibration sensors and so forth.

Although the embodiments only mention one-sided magnet arrangements or magnet arrangements which are symmetrical relative to the diaphragm, which have a mirrored second magnet arrangement on the opposite side of the diaphragm, the invention can also be used with magnet arrangements which are asymmetrical relative to the diaphragm and with any desired hybrid forms. For example another magnet arrangement according to the invention or even a conventional magnet arrangement can be disposed on the other side of the diaphragm. The magnet plate can also be in the form of a magnet grid.

When a transducer is referred to in the description this means a sound transducer or vibration sensor. The embodiments by way of example are set forth in relation to a sound transducer functioning as a sound generator (loudspeaker or headphone for electro-acoustic conversion). They also correspondingly apply however in regard to another use of the transducer, for example as a sound receiver (microphone for acoustic-electrical conversion).

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A planar dynamic transducer comprising:

a diaphragm;

a flat coil fixed to the diaphragm; and a first magnet arrangement disposed on a first side of the diaphragm, and having at least one permanently magnetized magnet plate;

wherein the magnet plate is one-sided multipole magnetized, wherein the magnetized side of the magnet plate faces towards the diaphragm;

wherein the magnet plate includes a plurality of elongate air gaps extending in substantially parallel relationship;

wherein a plurality of magnetic poles, which includes at least one North pole and one South pole, are disposed on the magnetized side of the magnet plate at each side along each air gap respectively; and wherein conductor tracks of the flat coil are disposed between the magnetic poles of the first magnet arrangement and extend transversely relative to the air gaps.

2. The planar dynamic transducer as set forth in claim 1; wherein there are no magnetic poles on a side of the magnet plate that is remote from the diaphragm.

3. The planar dynamic transducer as set forth in claim 1; wherein the plurality of elongate air gaps comprises at least three air gaps.

4. The planar dynamic transducer as set forth in claim 1; wherein at least two of the air gaps of the plurality of elongate air gaps are of differing widths.

5. The planar dynamic transducer as set forth in claim 1, further comprising:

a second magnet arrangement identical to the first magnet arrangement and disposed on a second side of the diaphragm opposite to the first side.

6. The planar dynamic transducer as set forth in claim 1; wherein at least two of the air gaps of the plurality of elongate air gaps are of differing lengths.

7. The planar dynamic transducer as set forth in claim 1; wherein the magnet plate has a cross-section between two air gaps that is non-rectangular.

8. The planar dynamic transducer as set forth in claim 1; wherein each air gap has a narrow side and a long side, with the long side extending over at least a quarter of the magnet plate.

9. A microphone comprising:

at least one planar dynamic transducer as set forth in claim 1.

10. A headphone or earphone comprising:

at least one planar dynamic transducer as set forth in claim 1.

11. The planar dynamic transducer as set forth in claim 1; wherein the magnet plate is manufactured as a single piece.

12. The planar dynamic transducer as set forth in claim 1; wherein the magnet plate comprises a peripheral portion surrounding the plurality of elongate air gaps.

13. The planar dynamic transducer as set forth in claim 12;

wherein the peripheral portion of the magnet plate has magnetic poles located on a narrow side of at least one of the plurality of elongate air gaps.

14. The planar dynamic transducer as set forth in claim 1; wherein the magnet plate has a substantially oval shape.

* * * * *